US007927222B2

(12) United States Patent
Pantoni

(10) Patent No.: US 7,927,222 B2
(45) Date of Patent: Apr. 19, 2011

(54) PORTABLE SANDBOX

(75) Inventor: Tom Pantoni, Darien, IL (US)

(73) Assignee: Thomas Pantoni, Darien, IL (US)

( * ) Notice: Subject to any disclaimer, the term of this patent is extended or adjusted under 35 U.S.C. 154(b) by 83 days.

(21) Appl. No.: 12/424,035

(22) Filed: Apr. 15, 2009

(65) Prior Publication Data

US 2010/0267458 A1 Oct. 21, 2010

(51) Int. Cl.
*A63G 31/00* (2006.01)
*A63H 33/32* (2006.01)

(52) U.S. Cl. ..... 472/126; 446/70; 108/25

(58) Field of Classification Search ..... 472/126, 472/136, 137; 446/70–77; 108/25–26
See application file for complete search history.

(56) References Cited

U.S. PATENT DOCUMENTS

| | | | | |
|---|---|---|---|---|
| 859,002 | A * | 7/1907 | Miller | 472/126 |
| 1,018,373 | A * | 2/1912 | Robbins | 472/126 |
| 2,673,086 | A * | 3/1954 | Brown, Sr | 472/126 |
| 2,848,229 | A * | 8/1958 | Miller | 297/158.3 |
| 3,454,272 | A * | 7/1969 | Rekow et al. | 472/126 |
| 4,091,998 | A * | 5/1978 | Peterson | 239/283 |
| 5,055,081 | A * | 10/1991 | Nayak | 446/75 |
| 5,656,226 | A * | 8/1997 | McVicker | 264/318 |
| 5,928,086 | A * | 7/1999 | Strickland | 472/126 |
| 6,616,539 | B1 * | 9/2003 | Gatto et al. | 472/126 |
| 6,694,893 | B2 * | 2/2004 | Alcala et al. | 108/50.17 |
| 7,510,479 | B2 * | 3/2009 | Stengel | 472/126 |

* cited by examiner

*Primary Examiner* — Kien T Nguyen

(57) ABSTRACT

A portable sandbox for carrying sand is provided. The portable sandbox includes a support frame and a carrier body. The support frame includes a front axle and a rear axle, a first and a second pair of upright support members, at least two front wheels where each of the at least two wheels is pivotally connected to an end portion of the front axle, at least two rear wheels where each of the at least two wheels is pivotally connected to an end portion of the rear axle, and a base member comprising a first and a second pair of arms. The carrier body includes a bottom enclosure disposed on the base member of the support frame, and front and rear side panels extending vertically upwards from the bottom enclosure. Furthermore, the portable sandbox includes a handle securely attached to the support frame for pulling the portable sandbox.

11 Claims, 6 Drawing Sheets

PORTABLE SANDBOX

FIELD OF THE INVENTION

The present invention generally relates to children's playground devices, and more specifically, to a portable sandbox for carrying sand for children.

BACKGROUND OF THE INVENTION

Various types of sandboxes serve as a means for entertainment for children. Specifically, children love to play in sand contained in a sandbox, and further perform various activities in the sand. Suitable examples of the various activities performed by children include, but are not limited to, building castles or cities, and wiggling their fingers and toes in the sand. Further, it has been observed that children are fond of playing in sand found in areas, which are exposed to sunlight, for long hours. For example, the children are fond of playing in sand at beaches. Accordingly, for prolonged entertainment of the children, many parents and caretakers prefer to install such sandboxes in areas, which are either nearby their houses or in yards of the houses, and are exposed to the sunlight.

Various conventional sandboxes are available that may be employed in the vicinity of a house or in a yard of the house. However, installation of most of the conventional sandboxes involves permanent setting of the sandboxes at a particular location of the house or the yard. Accordingly, the children may dislike playing in the sandboxes fixed at a particular location when such a location is not properly exposed to the sunlight after a change in the position of the sun. Further, the children may feel irritated, dismayed and depressed. In addition, often the parents and the caretakers feel the need for an easy relocation of the sandboxes to prevent formation of unsightly dead spots over areas, which are exposed to intense sunlight or which remain hidden under immovable sandboxes. As a result, the parents and the caretakers feel unsatisfied with the use of such sandboxes as they are unable to position the sandboxes in an area exposed to sunlight, as and when there is a change in position of the sun.

Accordingly, efforts have been made to develop sandboxes, which are capable of being transported from one location to another. However, such conventional sandboxes are made of heavy but fragile and non-durable materials, accordingly, are incapable of withstanding weight of sand and children playing within such sandboxes. Further, it is difficult to move such conventional sandboxes, as and when desired, due to their heavy weight. Furthermore, some of the conventional sandboxes, which are bulky but fragile, collapse easily while in use, thereby causing injuries to the children playing there within. In addition, the conventional sandboxes lack provisions for height adjustments in order to allow lowering of the sandboxes, as and when desired by a user.

Accordingly, there exists a need for a portable sandbox for carrying sand for children, which may easily and conveniently be positioned at a desired location. Further, there exists a need for a portable sandbox, which is durable, lightweight in design and safe-to-use without causing any injury to children while they are playing there within. Furthermore, there exists a need for a portable sandbox, which is capable of undergoing height adjustments in order to allow, lowering of the portable sandbox, as and when desired by a user.

SUMMARY OF THE INVENTION

In view of the foregoing disadvantages inherent in the prior art, the general purpose of the present invention is to provide a portable sandbox for carrying sand for children, which includes all the advantages of the prior art, and overcomes the drawbacks inherent therein.

Accordingly, an object of the present invention is to provide a portable sandbox for carrying sand for children, which may easily and conveniently be positioned at a desired location.

Another object of the present invention is to provide a portable sandbox, which is durable, lightweight in design and safe-to-use without causing any injury to children while they are playing within.

Another object of the present invention is to provide a portable sandbox, which is capable of undergoing height adjustments in order to allow lowering of the portable sandbox, as and when desired by a user.

In light of the above objects, the present invention discloses a portable sandbox for carrying sand. The portable sandbox comprises a support frame and a carrier body. The support frame comprises a front axle and a rear axle. The support frame further comprises a first pair of upright support members, each of the first pair of upright support members comprising an aperture configured at a lower portion thereof for receiving an end portion of the front axle therethrough, such that the end portion of the front axle extends outwardly through the aperture of the each of the first pair of upright support members. Furthermore, the support frame comprises at least two front wheels, each of the at least two front wheels pivotally connected to the end portion of the front axle. In addition, the support frame comprises a second pair of upright support members, each of the second pair of upright support members comprising an aperture configured at a lower portion thereof for receiving an end portion of the rear axle therethrough, such that, the end portion of the rear axle extends outwardly through the aperture of the each of the second pair of upright support members. Moreover, the support frame comprises at least two rear wheels, each of the at least two rear wheels pivotally connected to the end portion of the rear axle.

Additionally, the support frame comprises a base member comprising a first pair of arms and a second pair of arms. The first pair of arms extends longitudinally between support members of the first pair of upright support members and between support members of the second pair of upright support members. The second pair of arms extends laterally between the first pair of upright support members and the second pair of upright support members.

The carrier body of the portable sandbox comprises a bottom enclosure disposed on the base member of the support frame and front and rear side panels. The front and rear side panels extend vertically upwards from the bottom enclosure. The front side panels are removably attached to the first pair of upright support members of the support frame and the rear side panels are removably attached to the second pair of upright support members of the support frame. Further, the portable sandbox comprises a handle securely attached to the support frame for pulling the portable sandbox.

This together with other embodiments of the present invention, along with the various features of novelty that characterize the present invention, are pointed out with particularity in the claims annexed hereto and form a part of this disclosure. For a better understanding of the present invention, its operating advantages, and the specific objects attained by its uses, reference should be made to the accompanying drawings and the descriptive matter in which there are illustrated exemplary embodiments of the present invention.

BRIEF DESCRIPTION OF THE DRAWINGS

The advantages and features of the present invention will become better understood with reference to the following detailed description and claims taken in conjunction with the accompanying drawings, in which:

Like reference numerals refer to like parts throughout the description of the drawings.

DETAILED DESCRIPTION OF THE INVENTION

The exemplary embodiments described herein detail for illustrative purposes are subject to many variations in structure and design. It should be emphasized, however, that the present invention is not limited to a particular portable sandbox, as shown and described. It is understood that various omissions and substitutions of equivalents are contemplated as circumstances may suggest or render expedient, but these are intended to cover the application or implementation without departing from the spirit or scope of the claims of the present invention. Also, it is to be understood that the phraseology and terminology used herein is for the purpose of description and should not be regarded as limiting. The use of terms, "including," or "comprising," and variations thereof herein is meant to encompass the items listed thereafter and equivalents thereof as well as additional items. Further, the terms "a" and "an," as used herein, do not denote a limitation of quantity, but rather denote the presence of at least one of the referenced item. Furthermore, the terms "first," "second," and the like, as used herein do not denote any order, quantity, or importance, but rather are used to distinguish one element from another.

The terms "top", "bottom", and the like, herein do not denote any order, elevation or importance, but rather are used to distinguish placement of one element over another. Unless limited otherwise, the terms, "attached," "connected," "disposed" and variations thereof herein are used broadly, and may encompass direct and indirect attachments, connections and the like, to define association among various elements.

The present invention provides a portable sandbox that includes a support frame and a carrier body. The portable sandbox is capable of carrying sand, such as playground sand, within the carrier body for children. The children may play with the sand carried within the carrier body of the portable sandbox. Specifically, the children may either build castles or cities using the sand, or may wiggle their fingers and toes in the sand. The term "children," as used herein may relate either to a single child or to multiple children either playing or desiring to play within the portable sandbox.

Figure 1:
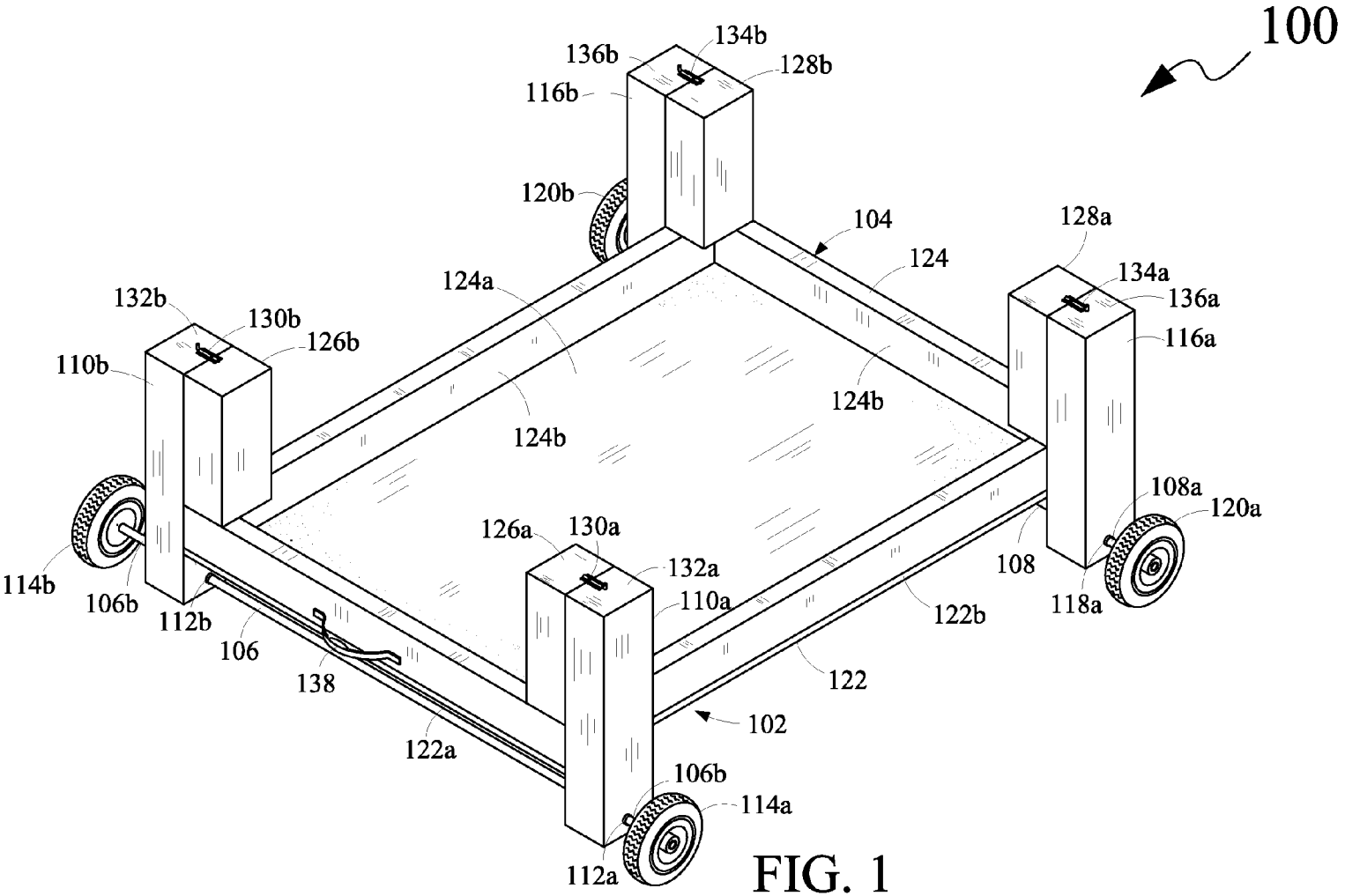
FIG. 1 depicts a perspective view of a portable sandbox, according to an exemplary embodiment of the present invention.
Figure 2A:
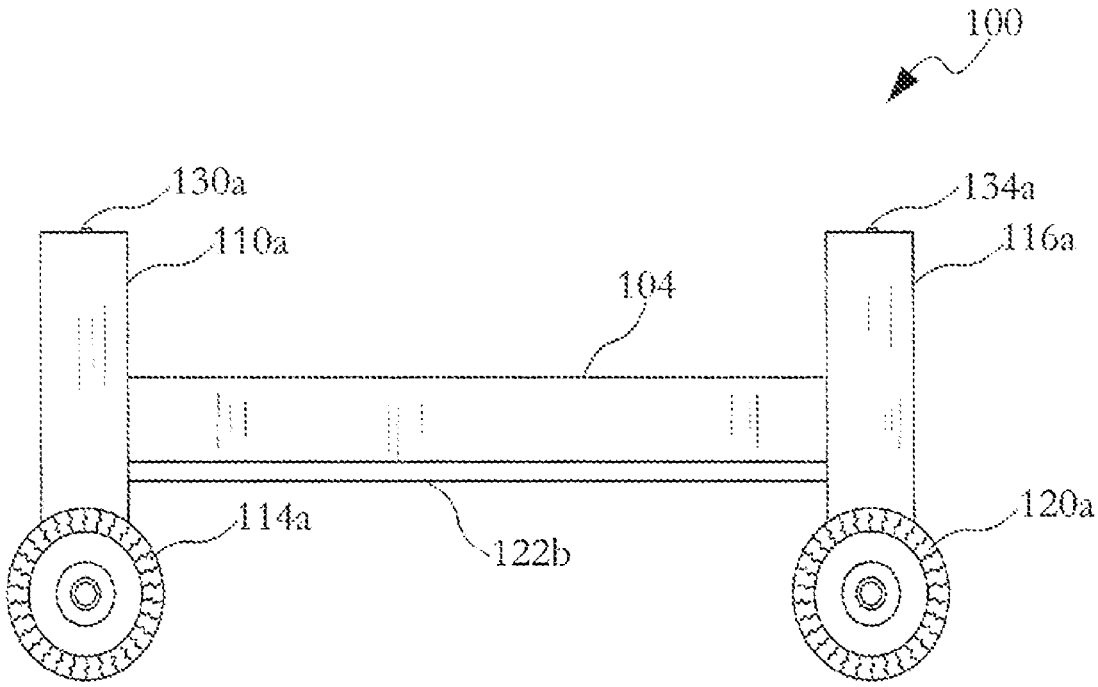
FIG. 2A depicts a side view of the portable sandbox of FIG. 1, according to an exemplary embodiment of the present invention.
Figure 2B:
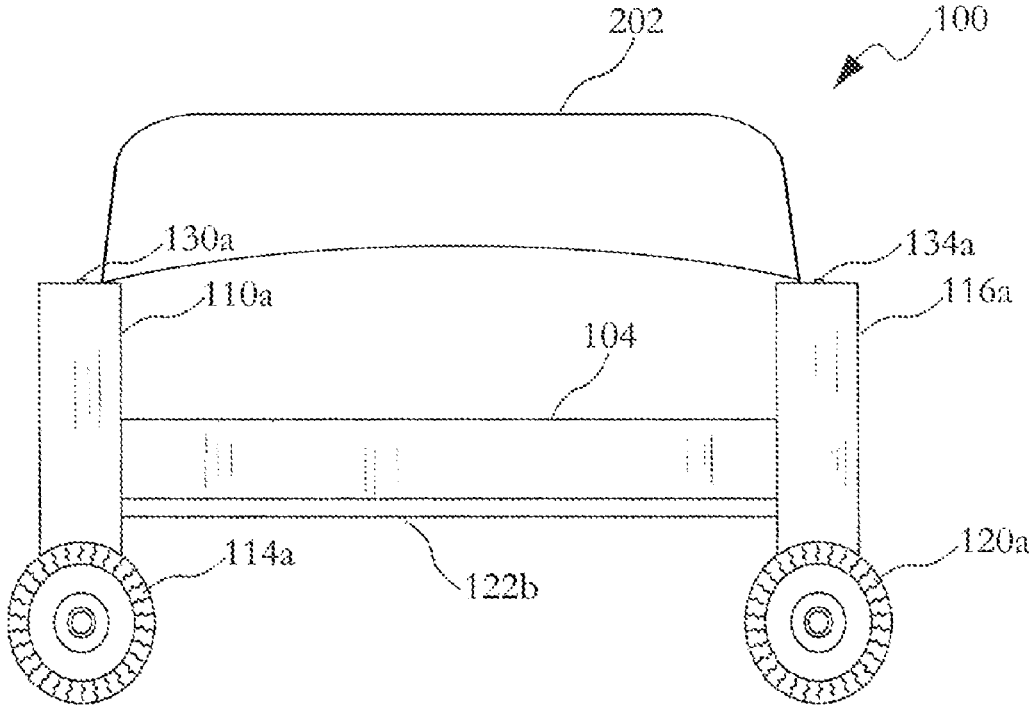
FIG. 2B depicts a side view of the portable sandbox of FIG. 1 which includes a cover according to another exemplary embodiment of the present invention.
Figure 3A:
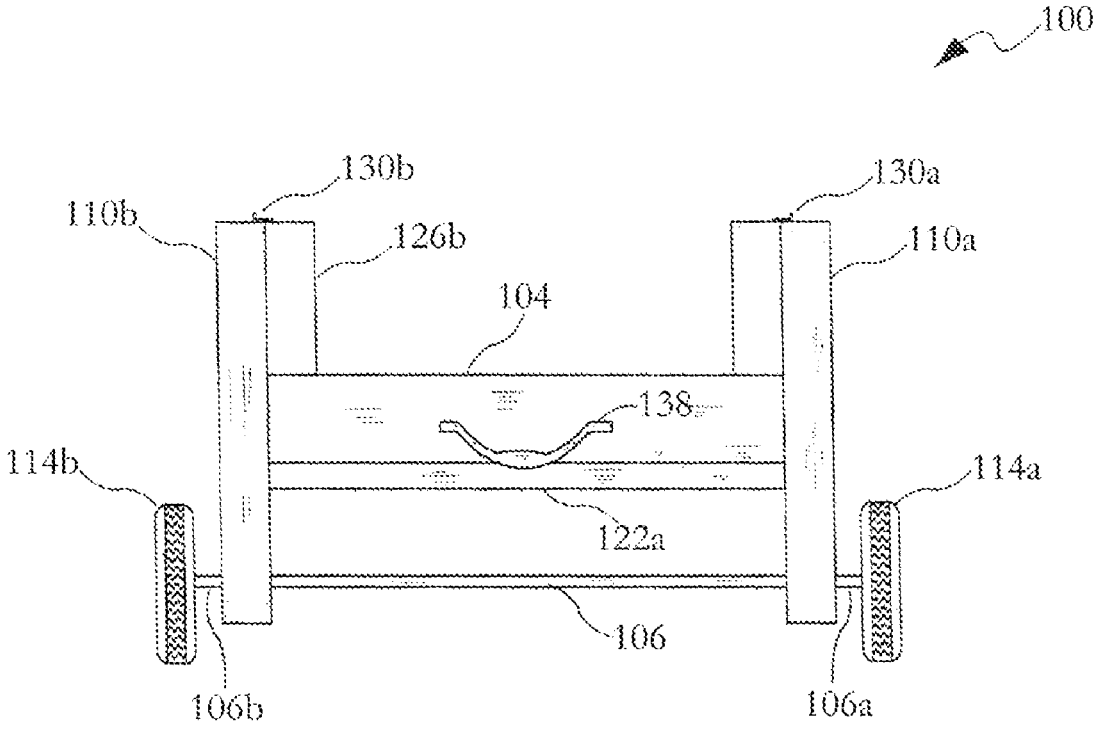
FIG. 3A depicts a front view of the portable sandbox of FIG. 1, according to an exemplary embodiment of the present invention.
Figure 3B:
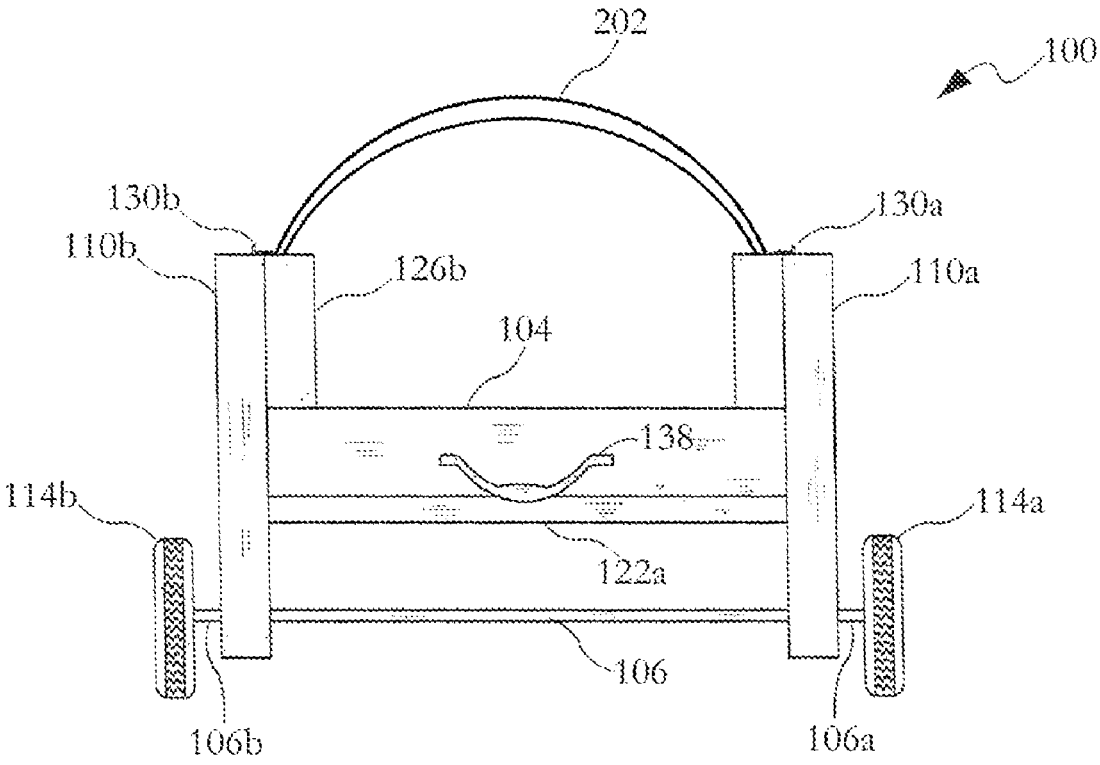
FIG. 3B depicts a front view of the portable sandbox of FIG. 1 which includes a cover lid according to another exemplary embodiment of the present invention.
Figure 4:
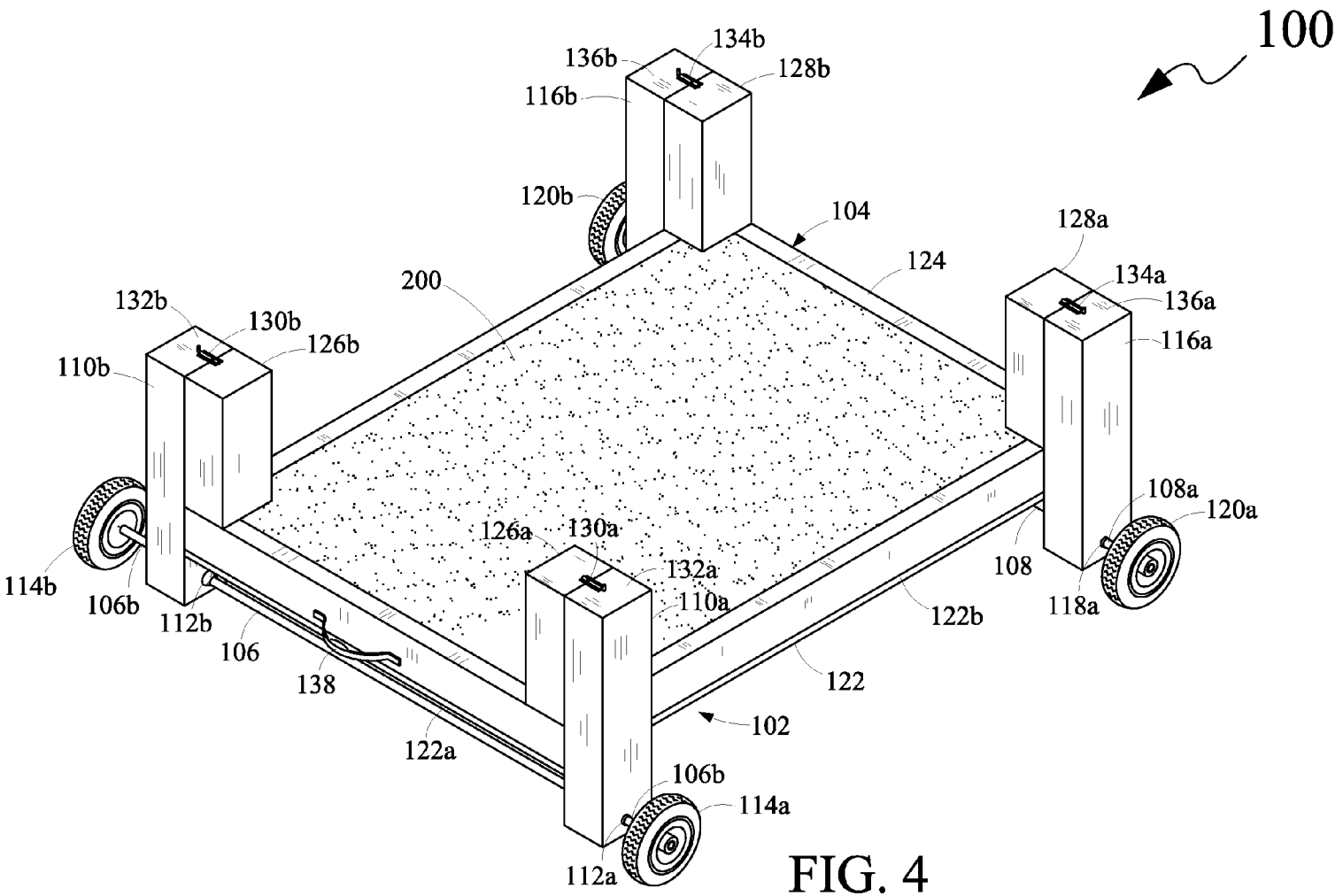
FIG. 4 depicts a perspective view of the portable sandbox of FIG. 1 carrying sand, according to an exemplary embodiment of the present invention.

The portable sandbox of the present invention is explained in detail in conjunction with FIGS. 1-4. FIG. 1 depicts a perspective view of a portable sandbox 100, according to an exemplary embodiment of the present invention. FIG. 2 depicts a side view of the portable sandbox 100 of FIG. 1, according to an exemplary embodiment of the present invention. FIG. 3 depicts a front view of the portable sandbox 100 of FIG. 1, according to an exemplary embodiment of the present invention. FIG. 4 depicts a perspective view of the portable sandbox 100 of FIG. 1 carrying sand, according to an exemplary embodiment of the present invention.

The portable sandbox 100 includes a support frame 102 and a carrier body 104. The support frame 102 includes a front axle 106 and a rear axle 108. The support frame 102 further includes a first pair of upright support members (hereinafter interchangeably referred to as "support members 110"), including a support member 110*a* and a support member 110*b*. Each of the support members 110 includes an aperture configured at a lower portion thereof for receiving an end portion of the front axle 106 therethrough, such that, the end portion of the front axle 106 extends outwardly through the aperture of the each of the support members 110. More specifically, the support member 110*a* includes an aperture 112*a* which is configured at a lower portion of the support member 110*a* for receiving an end portion 106*a* of the front axle 106 therethrough, such that, the end portion 106*a* of the front axle 106 extends outwardly through the aperture 112*a* of the support member 110*a*. Similarly, the support member 110*b* includes an aperture 112*b* which is configured at a lower portion of the support member 110*b* for receiving an end portion 106*b* of the front axle 106 therethrough, such that, the end portion 106*b* of the front axle 106 extends outwardly through the aperture 112*b* of the support member 110*b*. It should be apparent that the apertures 112*a-b* extend in the form of channels at respective lower portions of the support members 110 for allowing passage of the end portions 106*a-b* of the front axle 106 therethrough.

Furthermore, the support frame 102 includes at least two front wheels 114 (hereinafter referred to as "wheels 114"), such as a wheel 114*a* and a wheel 114*b*. Each of the wheels 114 may be pivotally connected to the end portion (such as the end portions 106*a-b*) of the front axle 106. More specifically, the wheel 114*a* may be pivotally connected to the end portion 106*a* of the front axle 106 and the wheel 114*b* may be pivotally connected to the end portion 106*b* of the front axle 106. To describe further, each of the support members 110 may include a bolt at a top portion thereof for attaching a wheel, such as the wheel 114*a*, to the respective lower portion of the each of the support members 110. Such an arrangement that provides pivotal connection of the wheels 114 and that allows for firmly securing the wheels 114 is explained below in detail. Specifically, the pivotal connection of the wheels 114 allows for swinging of the wheels 114 in an outward direction in order to lower a height of the portable sandbox 100. Alternately, such a pivotal connection may be achieved using a ball and socket type-bearing joint (not shown). The wheels 114 may have a diameter ranging from about 4 to about 10 inches (").

In addition, the support frame 102 includes a second pair of upright support members (hereinafter interchangeably referred to as "support members 116"), including a support member 116*a* and a support member 116*b*. Each of the support members 116 includes an aperture configured at a lower portion thereof for receiving an end portion of the rear axle 108 therethrough, such that, the end portion of the rear axle 108 extends outwardly through the aperture of the each of the support members 116. More specifically, the support member 116*a* includes an aperture 118*a* which is configured at a lower portion of the support member 116*a* for receiving an end portion 108*a* of the rear axle 108 therethrough, such that, the end portion 108*a* of the rear axle 108 extends outwardly through the aperture 118*a* of the support member 116*a*. Similarly, the support member 116*b* includes an aperture (not shown) which is configured at a lower portion of the support member 116*b* for receiving other end portion (not shown) of the rear axle 108 therethrough, such that, the other end portion of the rear axle 108 extends outwardly through the aperture of the support member 116*b*. It should be apparent that the aperture 118*a* of the support member 116*a* and the aperture of the support member 116*b* extend in the form of channels at respective lower portions of the support members 116 for allowing passage of end portions (such as the end portion 108*a*) of the rear axle 108 therethrough.

Moreover, the support frame 102 includes at least two rear wheels (hereinafter referred to as "wheels 120"), such as a wheel 120*a* and a wheel 120*b*. Each of the wheels 120 is pivotally connected to the end portion (such as the end portion 108*a* and the other end portion) of the rear axle 108. More specifically, the wheel 120*a* is pivotally connected to the end portion 108*a* of the rear axle 108 and the wheel 120*b* is pivotally connected to the other end portion of the rear axle 108. To describe further, each of the support members 116 may include a bolt at a top portion thereof for attaching a wheel, such as the wheel 120*a*, to the respective lower portion of the each of the support members 116. Such an arrangement that provides pivotal connection of the wheels 120 and that allows for firmly securing the wheels 120 is explained below in detail. Specifically, the pivotal connection of the wheels 120 allows for swinging of the wheels 120 in an outward direction in order to lower the height of the portable sandbox 100. Alternately, such a pivotal connection may be achieved using a ball and socket type-bearing joint (not shown). It should be apparent that the wheels 114 and 120 may together undergo swinging in the outward direction in order to provide a uniform lowering of the portable sandbox 100, as a whole structure. The wheels 120 may have a diameter ranging from about 4" to about 10".

With the help of the wheels 114 and 120, the portable sandbox 100 is capable of being transported according to a user's requirements. The term "user," as used herein, may relate to a parent or a caretaker of a child who is either playing or desiring to play within the portable sandbox 100. Specifically, the portable sandbox 100 may easily and conveniently be positioned at a location, which is exposed to adequate sunlight, as desired by a child or children playing there within.

Additionally, the support frame 102 includes a base member 122 comprising a first pair of arms (such as an arm 122*a*) extending longitudinally between the support members 110*a* and 110*b* of the first pair of upright support members and between the support members 116*a* and 116*b* of the second pair of upright support members. Further, the base member 122 includes a second pair of arms (such as an arm 122*b*) extending laterally between the first pair of upright support members and the second pair of upright support members. In an embodiment of the present invention, the first pair of arms and the second pair of arms may extend towards a center portion of the portable sandbox 100 to form a continuous sheet of the base member 122. The base member 122 may be vented for drainage. Further, the base member 122 may be made of a material, which is durable, such that the base member 122 is capable of withstanding respective weights of sand and child or children playing within the portable sandbox 100 and is capable for enabling an easy movement of the portable sandbox 100. Preferably, one inch thick plywood may be used for manufacturing the base member 122.

The support frame 102 of the portable sandbox 100 may be composed of a durable and lightweight material, such as a plastic material. More specifically, the front axle 106, the rear axle 108, the support members 110 and 116, and the base member 122 may be composed of the plastic material. Alternatively, the support frame 102, and more specifically components thereof, may be composed of wood, such as plywood. The wheels 114 and 120 may either be composed of the same material as used for manufacturing the other components of the support frame 102 or may be composed of material such as rubber.

The carrier body 104 includes a bottom enclosure 124 disposed on the base member 122 of the support frame 102. The bottom enclosure 124 serves as a sandbox for carrying sand 200 there within (as shown in FIG. 4). The bottom enclosure 124 has a floor 124*a* and walls, such as walls 124*b*, to define a container-type structure. The floor 124*a* rests on the base member 122 of the support frame 102 (as shown in FIGS. 1 and 2). The walls 124*b* of the bottom enclosure 124 are disposed and/or aligned over the first pair of arms and the second pair of arms of the base member 122 of the support frame 102. Alternatively, the walls 124*b* of the bottom enclosure 124 may be disposed adjacent and/or aligned with the first pair of arms and the second pair of arms of the base member 122 of the support frame 102. It should be apparent that the walls 124*b* of the bottom enclosure 124 are capable of being disposed adjacent and/or aligned with the first pair of arms and the second pair of arms of the base member 122 of the support frame 102, only when the carrier body 104 fits within an enclosure formed by the first pair of arms and the second pair of arms of the base member 122 of the support frame 102. Further, the walls 124*b* are capable of preventing spillage of the sand outside the portable sandbox 100.

Preferably, the bottom enclosure 124 of the carrier body 104 may be a 30"×40" sandbox. Further, the portable sandbox 100, as a whole, may be characterized by a dimension of about 36"×46". In an alternate embodiment, the bottom enclosure 124 may be designed to hold a sandbox there within. Specifically, the bottom enclosure 124 may be in the form of a square support for firmly holding the sandbox there within.

The carrier body 104 further includes front side panels 126*a* and 126*b* (hereinafter interchangeably referred to as "side panels 126"), and rear side panels 128*a* and 128*b* (hereinafter interchangeably referred to as "side panels 128"). The side panels 126 and 128 extend vertically upwards from the bottom enclosure 124 from respective corners thereof. In an embodiment of the present invention, the side panels 126 and 128 may be extended sideways to form continuous walls (not shown) of the portable sandbox 100, such that, the walls rest above the walls 124*b* of the bottom enclosure 124 of the carrier body 104.

The side panels 126 are removably attached to the support members 110 of the support frame 102. More specifically, the support frame 102 includes a first pair of bolts (hereinafter interchangeably referred to as "bolts 130"), including a bolt 130*a* and a bolt 130*b*. Each of the bolts 130 is configured on a top surface, such as top surfaces 132*a* and 132*b*, of the support members 110*a* and 110*b*, respectively. The bolts 130 are employed onto the support frame 102 for removably attaching the first pair of upright support members to the front side panels 126 of the carrier body 104.

Similarly, the side panels 128 are removably attached to the support members 116 of the support frame 102. More specifically, the support frame 102 includes a second pair of bolts (hereinafter interchangeably referred to as "bolts 134"), including a bolt 134*a* and a bolt 134*b*. Each of the bolts 134 is configured on a top surface, such as top surfaces 136*a* and 136*b*, of the support members 116*a* and 116*b*, respectively. The bolts 134 are employed in the support frame 102 for removably attaching the second pair of upright support members to the rear side panels 128 of the carrier body 104.

In one embodiment, the bolts 130 and 134 may be slide bolts with sliding portions affixed onto the support members 110 and 116, and receptacle portions affixed onto the side panels 126 and 128 (as depicted in FIG. 1). Specifically, the bolts 130 and 134 may be slide gate bolts, which prevent swinging of the support members 110 and 116. Accordingly, the bolts 130 and 134 may serve as locks to hold the portable sandbox 100 in an upright and noncollapsible state. In another embodiment of the present invention, the bolts 130 and 134 may be configured or mounted on a front portion or a rear portion of the portable sandbox 100 in order to hold the portable sandbox 100 in the upright and the noncollapsible state.

Further, the bolts 130 and 134 may allow swinging of the wheels 114 and 120 for lowering of the height of the portable sandbox 100. As described above, the bolts 130 and 134 may be the bolts that are utilized to attach the wheels 114 and 120 to the respective lower portions of the support members 110 and 116.

The carrier body 104 may be composed of a durable and a lightweight material, such as a plastic material. More specifically, the bottom enclosure 124, and the side panels 126 and 128 of the carrier body 104 may be composed of the plastic material. Alternatively, the carrier body 104, and more specifically, the aforementioned components thereof, may be composed of wood.

The portable sandbox 100 also includes a handle 138 securely attached to the carrier body 104 for pulling the portable sandbox 100 (as shown in FIGS. 1 and 3). The handle 138 may be an elongated handle to ensure easy pulling of the portable sandbox 100. Further, the handle 138 may be a foldable handle to help achieving an easy storage of the portable sandbox 100. Such a foldable handle 138 may include end portions capable of pivotally connecting to the carrier body 104, for allowing folding of the handle 138 either in an upward or a downward direction to align in a parallel orientation with respect to the carrier body 104. Specifically, locks may be used to provide pivotal connection of the foldable handle 138. In an embodiment of the present invention, the handle 138 may be a fence handle. Furthermore, the handle 138 may be composed of either wood or a plastic material. Additionally, a plurality of foldable handles, such as the foldable handle 138, may be attached to the portable sandbox 100 for providing ease during transportation of the portable sandbox 100.

In another embodiment of the present invention, the handle 138 is securely attached to the support frame 102 of the portable sandbox 100.

In addition, a covering lid (not shown) may be employed in the portable sandbox 100, when not in use by children. The covering lid may be securely attached onto top surfaces (not shown) of the side panels 126 and 128 of the carrier body 104. Specifically, the covering lid may be able to securely attach onto top surfaces (not shown) of the side panels 126 and 128 of the carrier body 104, using a frictional fit. It should be apparent to a person skilled in the art that the covering lid may be attached using any other mechanism that is known in the art for attaching a cover to a device, such as a sandbox. The covering lid may be a dome-shaped covering lid. Further, the covering lid may be made of a sturdy and a lightweight material.

Alternately, the covering lid may be securely attached onto the respective top surfaces 132*a* and 132*b* of the support members 110*a* and 110*b*, and the respective top surfaces 136*a* and 136*b* of the support members 116*a* and 116*b* of the support frame 102.

The present invention provides a portable sandbox, such as the portable sandbox 100, for carrying sand for children's entertainment. More specifically, the portable sandbox serves as a wagon by offering a sandbox in the form of a carrier body with wheels pivotally connected thereto. With the help of wheels, the portable sandbox may easily be transported from one location to another based on a user's preference. Specifically, the portable sandbox may easily be moved towards a sunny spot in a lawn or a yard. Further, the portable sandbox serves as a source of entertainment for children during parties as well.

The pivotal arrangement of the wheels of the portable sandbox helps for adjusting, and more specifically, for lowering a height of the portable sandbox when more than a particular number of children (such as 3) are playing there within at a specific time. Said property of the portable sandbox helps ensuring safety of the children while playing within the portable sandbox.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, and thereby enable others skilled in the art to best utilize the invention and various embodiments with various modifications as are suited to the particular use contemplated. It is understood that various omissions and substitutions of equivalents are contemplated as circumstances may suggest or render expedient, but such are intended to cover the application or implementation without departing from the spirit or scope of the claims of the present invention.

What is claimed is:

1. A portable sandbox comprising:

a support frame comprising, a front axle and a rear axle, a first pair of upright support members, each of the first pair of upright support members comprising an aperture configured at a lower portion thereof for receiving an end portion of the front axle therethrough, such that, the end portion of the front axle extends outwardly through the aperture of the each of the first pair of upright support members, at least two front wheels, each of the at least two front wheels pivotally connected to the end portion of the front axle, a second pair of upright support members, each of the second pair of upright support members comprising an aperture configured at a lower portion thereof for receiving an end portion of the rear axle therethrough, such that, the end portion of the rear axle extends outwardly through the aperture of the each of the second pair of upright support members, at least two rear wheels, each of the at least two rear wheels pivotally connected to the end portion of the rear axle, and a base member comprising, a first pair of arms extending longitudinally between support members of the first pair of upright support members and between support members of the second pair of upright support members, and a second pair of arms extending laterally between the first pair of upright support members and the second pair of upright support members;

a carrier body comprising, a bottom enclosure disposed on the base member of the support frame, and front and rear side panels extending vertically upwards from the bottom enclosure, the front side panels removably attached to the first pair of upright support members of the support frame and the rear side panels removably attached to the second pair of upright support members of the support frame; and a handle securely attached to the support frame for pulling the portable sandbox.

2. The portable sandbox of claim 1, wherein the support frame further comprises a first pair of bolts, each of the first pair of bolts configured on a top surface of a support member of the first pair of upright support members for removably attaching a front side panel of the carrier body to the support member.

3. The portable sandbox of claim 1, wherein the support frame further comprises a second pair of bolts, each of the second pair of bolts configured on a top surface of a support member of the second pair of upright support members for removably attaching a rear side panel of the carrier body to the support member.

4. The portable sandbox of claim 1, further comprising a covering lid securely attached onto top surfaces of the front and rear side panels of the carrier body.

5. The portable sandbox of claim 4, wherein the covering lid is a dome-shaped covering lid.

6. The portable sandbox of claim 1, further comprising a covering lid securely attached onto top surfaces of the first pair of upright support members and the second pair of upright support members of the support frame.

7. The portable sandbox of claim 6, wherein the covering lid is a dome-shaped covering lid.

8. The portable sandbox of claim 1, wherein the support frame is composed of wood.

9. The portable sandbox of claim 1, wherein the support frame is composed of a plastic material.

10. The portable sandbox of claim 1, wherein the carrier body is composed of wood.

11. The portable sandbox of claim 1, wherein the carrier body is composed of a plastic material.

* * * * *